US005522149A

United States Patent [19]

Meyer

[11] Patent Number: 5,522,149

[45] **Date of Patent: *Jun. 4, 1996**

[54] SIDING APPLICATION AND GAUGE TOOL

[76] Inventor: Glen A. Meyer, 940 N. 10th, Stayton, Oreg. 97383

[ * ] Notice: The term of this patent shall not extend beyond the expiration date of Pat. No. 5,400,519.

[21] Appl. No.: 401,181

[22] Filed: Mar. 9, 1995

Related U.S. Application Data

[63] Continuation-in-part of Ser. No. 125,079, Sep. 21, 1993, Pat. No. 5,400,519.

[51] Int. Cl.[6] ..... G01B 3/30

[52] U.S. Cl. ..... 33/646; 33/647

[58] Field of Search ..... 33/646, 647, 648, 33/649, 411; 52/547, 548, 408, 105, 99

[56] References Cited

U.S. PATENT DOCUMENTS

| | | | |
|---|---|---|---|
| 399,898 | 3/1889 | Hosack . | |
| 454,017 | 6/1891 | Arnold | 33/646 |
| 652,256 | 6/1900 | Farmer . | |
| 774,114 | 11/1904 | Spear . | |
| 1,115,202 | 10/1914 | Ingles . | |
| 1,598,986 | 9/1926 | Ping . | |
| 4,208,799 | 6/1980 | Frantello . | |
| 4,425,714 | 1/1984 | Kelly, Jr. . | |
| 4,473,100 | 9/1984 | Wheeler . | |
| 5,400,519 | 3/1995 | Meyer | 33/646 |

FOREIGN PATENT DOCUMENTS

| | | | |
|---|---|---|---|
| 993650 | 7/1976 | Canada | 33/648 |

*Primary Examiner*—Christopher W. Fulton
*Attorney, Agent, or Firm*—Kolisch, Hartwell, Dickinson, McCormack & Heuser

[57] ABSTRACT

A siding application and gauge tool which permits one person to apply siding to a building. At one end a knife edge or hook is inserted behind the nailed siding. A top ridge is of sufficient width to fit over the top of the nailed siding. The overlap gauge fits adjacent to the nailed siding providing the proper overlap length for the next piece of siding. The material support section with stop, supports the piece of siding in an upright position. The length of the material support section with lip corresponds to the width of the exposed siding.

5 Claims, 3 Drawing Sheets

SIDING APPLICATION AND GAUGE TOOL

CROSS-REFERENCE TO RELATED APPLICATION(S)

This application is a continuation-in-part of application Ser. No. 08/125,079 filed Sep. 21, 1993, U.S. Pat. No. 5,400,519, issued Mar. 28, 1995.

BACKGROUND OF THE INVENTION

The present invention relates to support hangers and, more particularly, to support hangers and gauges designed to temporarily hold one end of a long piece of siding and to measure the overlap and the exposed siding.

In the housing industry, teams generally apply siding to a house. This allows for each member of the team to measure the proper overlap of siding and then attach the siding to the side of the home. Generally, the length of the siding prevents one person from performing the job alone. If one person could properly attach the siding, productivity would increase.

SUMMARY OF THE INVENTION

The preferred embodiment of the invention is a siding application and gauge tool with a knife edge extending downwards from a top ridge for insertion behind the prior course of siding. The top ridge is of sufficient length to fit over the top edge of said prior course of siding. An overlap section extending downward from said top ridge is the exact same length as the overlap of the next course of siding. The support section contains a stop for holding the siding in an upright position. The support section, with a lip at one end, is the exact length of the exposed width of the prior course.

It is an object of this invention to increase productivity in the application of siding.

It is a further object to provide an invention which precisely measures the overlap width and the exposed width of siding.

It is another object to provide an inexpensive, long lasting tool.

It is a final object to provide an easily insertable and removable tool when applying siding.

DETAILED DESCRIPTION OF THE PREFERRED EMBODIMENT

Figure 1:
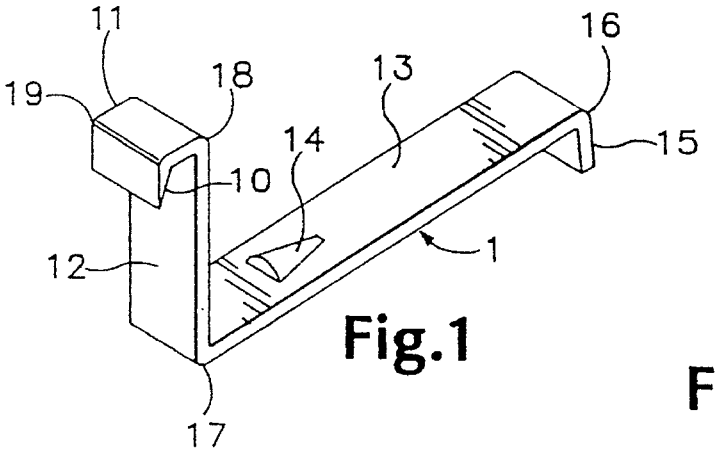
FIG. 1 is a perspective view of the preferred embodiment of the invention.
Figure 3:
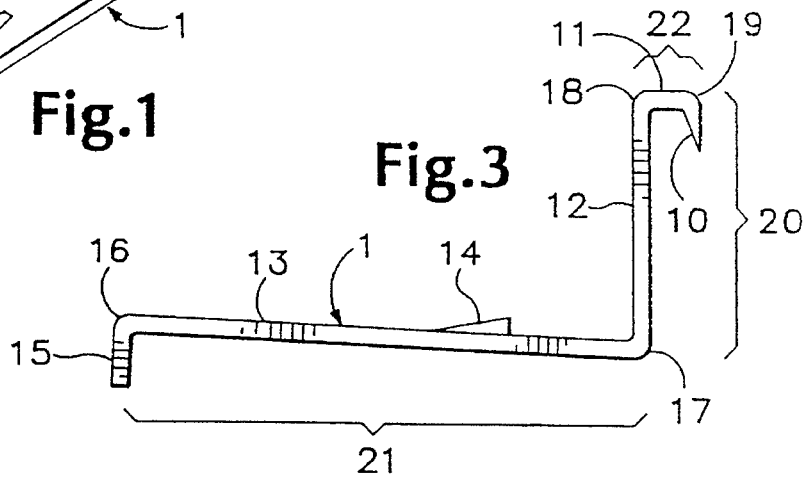
FIG. 3 is a side view of the preferred embodiment of the invention.

The siding application and gauge tool 1 can be made of any material, however, spring steel is preferred because of the accuracy of bending and durability of the material. The tool 1 is made of one piece of material with bends. The knife edge 10 is made thin enough to slip between attached siding of any shape and exterior wall and is the full width of the tool 1. The knife edge 10 extends in a generally downward direction from the top ridge 11 through knife edge bend 19. The top ridge 11 is of length such that it slides over the top of siding. The length is shown as siding thickness width 22. The overlap section 12 extends downward from the top ridge 11 by means of an overlap bend 18. The length of overlap section 12 is denominated as overlap length 20. The support section 13 is formed by support bend 17. The exposed width 21 is the length of the support section 13. A stop 14 is provided to the support section 13 to prevent siding from sliding off the tool 1. Lip 15 extends from one end of the support section 13 by means of lip bend 16.

Figure 4:
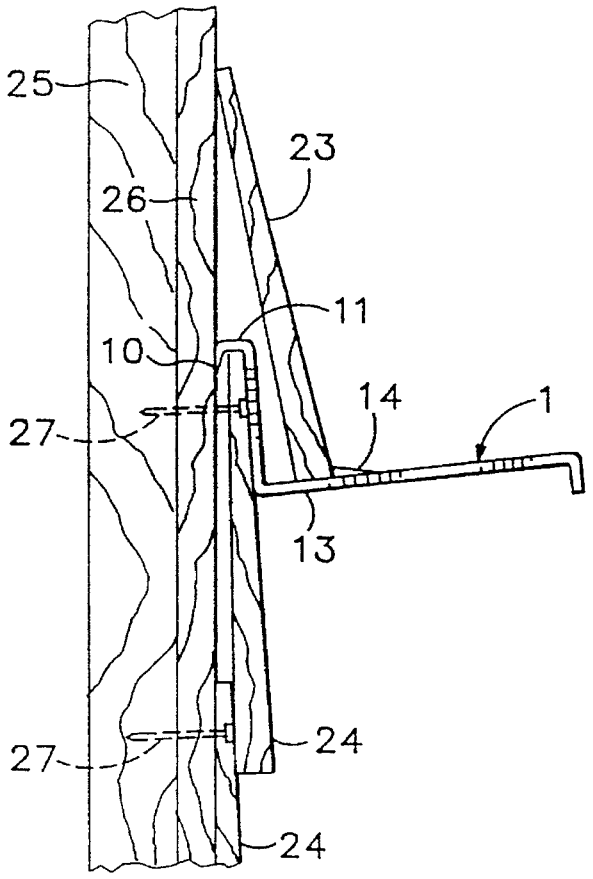
FIG. 4 is a side view of the preferred embodiment invention inserted in the siding.
Figure 5:
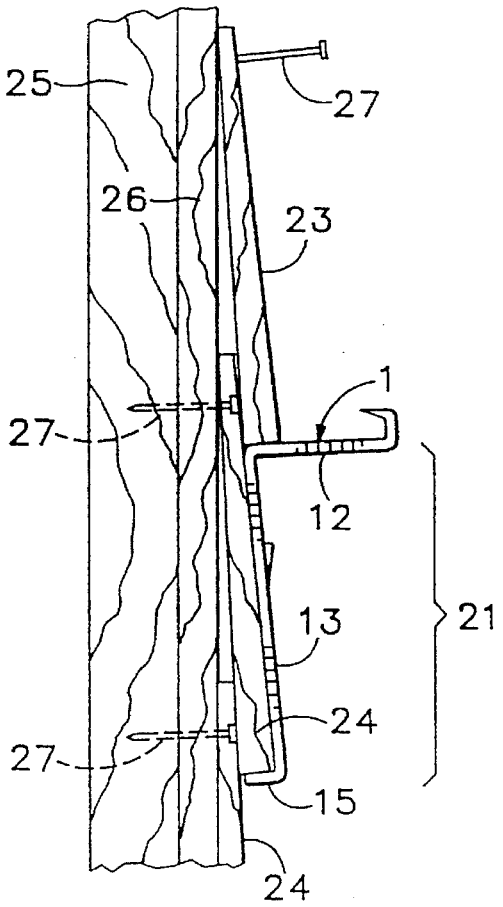
FIG. 5 shows the support section used as a gauge.

FIGS. 4 and 5 show the substructure. Stud 25 has sub siding 24 attached along with the siding 23 held by nails 27. Previously attached siding 24 is shown.

The method of applying siding uses the following steps:

Step 1: Snapping a chalk line for a first course of siding;

Step 2: Attaching the first course of siding along the chalk line;

Step 3: Placing the top ridge of a first siding application and gauge tool over the top of the first course of siding near one end;

Step 4: Placing a second course of siding on the first tool's support section;

Step 5: Taking a second siding application and gauge tool;

Step 6: Placing the lip of the second siding application and gauge tool against the bottom of the first course of siding near the end of the siding away from the first siding application and gauge tool;

Step 7: Placing the second course of siding on the second tool's overlap section;

Step 8: Using the support section of the second tool as a gauge to position the second course of siding;

Step 9: When the second course of siding is properly positioned, attaching the end of the second course of siding away from the first siding application and gauge tool;

Step 10: Repeating steps 8 and 9 while moving the second tool toward the first tool;

Step 11: Remove the first tool and use the second tool to finish attaching the second course of siding; and Step 12: Repeating the above steps for subsequent courses of siding until all courses are attached.

Figure 6:
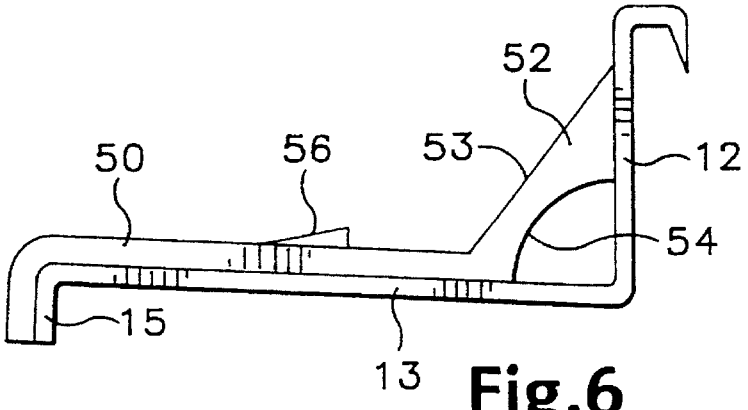
FIGS. 6 and 7 show side plan and top perspective views, respectively, of an alternative embodiment of the invention.
Figure 7:
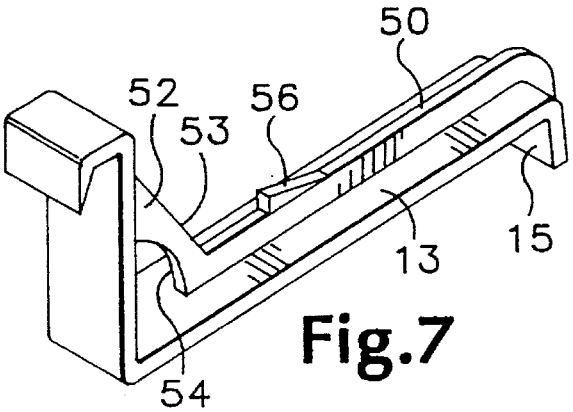

The siding application and gauge tool may also be made of a synthetic material, for example a suitable plastic. In such a case, the tool may include a supporting ridge 50, as shown in FIGS. 6 and 7. The ridge extends over lip 15 and the length of support section 13.

Ridge 50 also includes an end portion 52 which extends upward from support section 13 to overlap section 12. End portion 52 includes an angled surface 53 sloping from support section 13 to overlap section 12. Surface 53 is sloped to help direct siding against a stop 56, which prevents siding from slipping off the tool, and also to help the siding lean against a building during installation. This facilitates precise installation of the siding.

Figure 2:
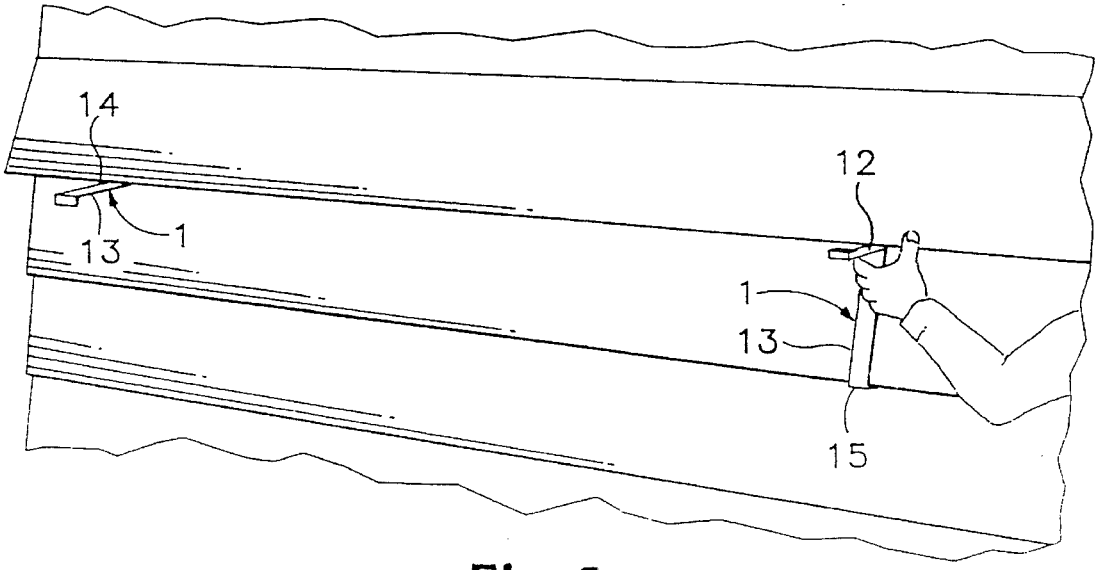
FIG. 2 is a perspective view of the preferred embodiment in use.

End portion 52 includes an opening 54 which allows a user to put a finger through so that the user can easily hold the device, as shown in FIG. 2. It is important that the opening be positioned near both overlap section 12 and support section 13 so that the user can properly position the tool when in use by pushing the corner where sections 12 and 13 join against the siding, also as shown in FIG. 2.

The tool may be approximately 6-inches in length from the overlap section 12 to the lip 15, and the support section 13 may be approximately 1-inch wide from side-to-side.

Figure 8:
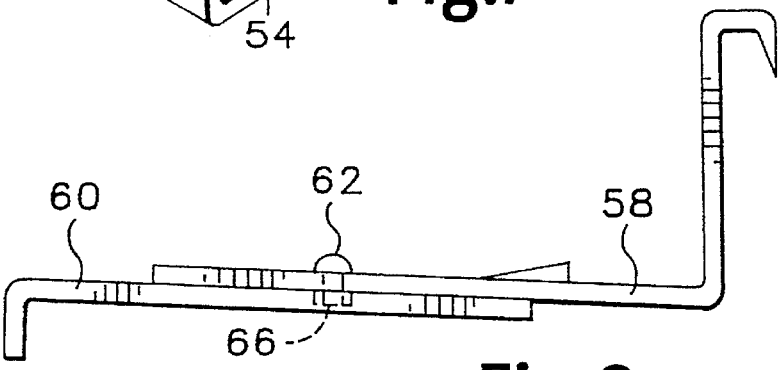
FIGS. 8 and 9 are side and top views, respectively, of an adjustable tool.
Figure 9:
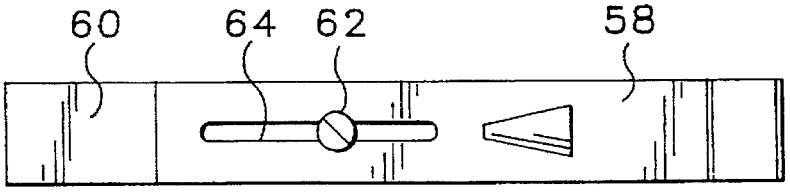

The tool may also be adjustable in length to accommodate siding of various sizes. An adjustable tool is shown in FIGS. 8 and 9, including a first section 58 and a second section 60. The two sections are held together by a screw 62 which extends through a slot 64 in first section 58 and into a tapped hole 66 in second section 60. Loosening the screw allows the two sections to slide relative to each other, thereby extending the length of the tool. Of course, the tool can be made adjustable in any one of numerous ways, not only the way described above.

While embodiments of the invention have been described, modifications and changes may be made thereto without departing from the spirit of the invention.

I claim:

1. A siding application tool comprising:

an elongate member having a first end, a second end and an upper surface;

a lip at the first end extending outwardly in a first direction at a substantially orthogonal angle from the upper surface, said lip being substantially planar;

an overlap section at the second end extending outwardly in a second direction substantially opposite the first direction, where the overlap section includes a first side facing the first end;

a hook positioned on the overlap section away from the elongate member's second end, where the hook includes a segment hooking away from the overlap section's first side; and a strengthening ridge running along the elongate member between the first and second ends.

2. The siding application tool of claim 1 where the strengthening ridge extends along the lip.

3. The siding application tool of claim 2 where the strengthening ridge includes an opening near the overlap section sufficient for a user to put a finger through the opening.

4. A siding application tool comprising:

an elongate member having a first end, a second end and an upper surface;

a lip at the first end extending outwardly in a first direction at a substantially orthogonal angle from the upper surface, said lip being substantially planar;

an overlap section at the second end extending outwardly in a second direction substantially opposite the first direction, where the overlap section includes a first side facing the first end;

a hook positioned on the overlap section away from the elongate member's second end, where the hook includes a segment hooking away from the overlap section's first side; and where the elongate member is adjustable to vary its length.

5. The siding application tool of claim 4 where the elongate member comprises first and second sections held together in a slidable relationship relative to each other.

* * * * *